US008939525B1

(12) United States Patent
Chen

(10) Patent No.: US 8,939,525 B1
(45) Date of Patent: Jan. 27, 2015

(54) SELF-CLOSING BUFFER AND AUTOMATIC REBOUND MECHANISM FOR SLIDE RAIL

(71) Applicant: Martas Precision Slide Co., Ltd., New Taipei (TW)

(72) Inventor: Wan-Lai Chen, New Taipei (TW)

(73) Assignee: Martas Precision Slide Co., Ltd., New Taipei (TW)

( * ) Notice: Subject to any disclaimer, the term of this patent is extended or adjusted under 35 U.S.C. 154(b) by 0 days.

(21) Appl. No.: 14/164,532

(22) Filed: Jan. 27, 2014

(51) Int. Cl.
*A47B 95/00* (2006.01)
*A47B 88/04* (2006.01)

(52) U.S. Cl.
CPC ..... *A47B 88/047* (2013.01)
USPC ..... 312/333

(58) Field of Classification Search
CPC ..... A47B 88/047; A47B 88/0481
USPC ..... 312/333, 319.1, 330.1, 334.1, 334.7, 312/334.8, 334.11, 334.44, 334.46, 334.47
See application file for complete search history.

(56) References Cited

U.S. PATENT DOCUMENTS

| | | | | |
|---|---|---|---|---|
| 7,244,005 | B1 * | 7/2007 | Lu | 312/333 |
| 7,465,000 | B2 * | 12/2008 | Huang | 312/333 |
| 7,914,093 | B2 * | 3/2011 | Huang | 312/333 |
| 7,980,640 | B2 * | 7/2011 | Yang | 312/333 |
| 8,132,873 | B2 * | 3/2012 | Yang | 312/333 |
| 8,256,853 | B2 * | 9/2012 | Chen et al. | 312/333 |
| 8,393,693 | B2 * | 3/2013 | Juan et al. | 312/333 |
| 8,485,616 | B2 * | 7/2013 | Chen et al. | 312/333 |
| 8,496,306 | B2 * | 7/2013 | Chen et al. | 312/333 |
| 8,590,989 | B2 * | 11/2013 | Lowe | 312/319.1 |
| 8,696,077 | B2 * | 4/2014 | Huang et al. | 312/333 |
| 8,783,799 | B2 * | 7/2014 | Chen | 312/333 |
| 8,801,120 | B2 * | 8/2014 | Chen et al. | 312/333 |
| 2008/0100190 | A1 * | 5/2008 | Yang et al. | 312/333 |
| 2010/0164340 | A1 * | 7/2010 | Juan et al. | 312/333 |
| 2011/0215690 | A1 * | 9/2011 | Juan et al. | 312/319.1 |

FOREIGN PATENT DOCUMENTS

| | | |
|---|---|---|
| TW | M370971 | 12/2009 |
| TW | I319465 | 1/2010 |
| TW | M385280 | 8/2010 |
| TW | I404868 | 8/2013 |

* cited by examiner

*Primary Examiner* — Darnell Jayne
*Assistant Examiner* — Hiwot Tefera
(74) *Attorney, Agent, or Firm* — Rosenberg, Klein & Lee

(57) ABSTRACT

A self-closing buffer and automatic rebound mechanism for a slide rail includes a buffer body, a buffer slide block, a buffer hook block, a buffer element, at least one pull-back spring, at least one push-out spring, a pressing toggle plate and a pressing block. The slide rail consists of an outer rail, a middle rail and an inner rail, and the inner and middle rails can be sequentially pulled and extended outward or pushed inwardly, overlapped and shortened. The slide rail is installed between a drawer and a cabinet for use. When the drawer is pushed inwardly to a certain degree, the drawer is pulled back automatically to a locked position, and the pushing force is damped to lower noises. After the drawer is pushed again, the drawer is rebounded automatically to a certain distance to facilitate operations that follow, so as to improve the convenience of use significantly.

7 Claims, 12 Drawing Sheets

SELF-CLOSING BUFFER AND AUTOMATIC REBOUND MECHANISM FOR SLIDE RAIL

BACKGROUND OF THE INVENTION

1. Field of the Invention

The present invention relates to the field of a slide rail for cabinets, and more particularly to a self-closing buffer and automatic rebound mechanism for slide rails with the functions of buffering and lowering noises when closing the a cabinet and automatic ejection by pressing.

2. Description of the Related Art

In recent years, various slide rails structure such as those with a drawer interlock function, an automatic return function and a closing buffer function or even combined with the automatic return function and the buffer function are used extensively in industrial applications and even for cabinets at home, and these slide rails improve the smoothness and safety of pulling out a drawer.

An improved automatic closing device of a slide rail as disclosed in R.O.C. Pat. No. M385280, and I319465 serves as a buffer self-closing device for a slide rail and comprises a self-closing fastener, at least one elastic element and a buffer element, wherein the elastic element provides a pull-back force required by the slide rail assembly, and the self-closing fastener automatically closes the slide rail assembly to prevent the slide rail assembly from sliding to open accidentally at a non-operating status. In addition, the buffer element has a damping function to reduce the impact force when the slide rail assembly is withdrawn and prevent users from being clamped or injured by the fast-moving slide rail components.

In addition, an auxiliary positioning apparatus for slide rail assembly as disclosed in R.O.C. Pat. No. I404868 comprises a positioning element pivotally coupled to a first rail, and the positioning element comprises: a latch; a guide seat coupled to the second rail, and including a first channel, a first groove and a first wall, wherein the first wall has a first guide surface disposed opposite to the first channel; a second channel; a second groove and a second wall, and the second wall has a second guide surface disposed opposite to the second channel; a separator, having a guide end opposite to the first groove; a latching member having a latching surface, and a portion of the latching surface being disposed opposite to the second groove; a third channel, a third groove and a third wall, and the third wall has a third guide surface disposed opposite to the other portion of the latching surface; and a fourth wall has a fourth guide surface; a link element, corresponding to the positioning element. If the second rail is situated at a position opposite to the first rail at a received position, the latch will be situated in the first channel, so that when the rail is pushed inwardly by a force, the latch is moved into the first groove, and when the force is released and one of the rails is ejected, the latch is guided by the separator to pass through the second channel. When the rail is pushed inwardly and received, the latch and the latching member are engaged with each other. When a pushing force is applied to the rail again, the latch and the latching member are disconnected, and the latch is released through the third groove and the third channel, so as to define a three-stage press locking/unlocking function.

A drawer automatic opening and closing buffer device as disclosed in R.O.C. Pat. No. M370971 is installed between a drawer and a cabinet, and the drawer automatic opening and closing buffer device comprises: a fixing base, fixed at a predetermined position of an inner wall of the cabinet, and having a buffer cylinder installed onto a side of the fixing base, and a positioning portion disposed on the other side of the fixing base, and the fixing base further including two guide slots; a slide seat, with a side coupled to a shaft of the buffer cylinder by sheathing guide portions on both sides on two guide slots of the fixing base respectively, and having a swing element pivotally installed to a side of the slide seat and a slide hook pivotally installed to the other side of the slide seat, and the slide seat further including two guide slots disposed opposite to each other, and each guide slot having a stop portion; a self-opening control element, having a hook block and a latch portion capable of latching and positioning the swing element, and one or more guide columns disposed on both sides of the self-opening control element, such that the self-opening control element can be slid into the two guide slots of the slide seat through the guide columns, and the self-opening control element is coupled to a side of an elastic element, and the other side of the elastic element is coupled to the other side of the slide seat; one or more slide seat resetting elastic elements, with an end coupled to the slide seat and the other end coupled to a predetermined position of a connecting portion of the fixing base or an inner wall of the cabinet; a slide hook, pivotally installed to a side of the slide seat and having a hook portion, a latch portion and an abutting portion, wherein the latch portion can be latched to the positioning portion of the fixing base; a starting frame, mounted to a predetermined position of an outer wall of the drawer and having a link element disposed on a side of the staring frame, a link portion disposed on a side of the link element for linking the hook block of the self-opening control element, and an abutting portion disposed at the link element for abutting the hook block of the slide hook, wherein the other side of the starting frame has a starting portion for abutting the abutting portion of the slide hook. Therefore, the side-locked ball-bearing slide rail originally having the basic functions of pulling or pushing the drawer out of or into the cabinet can also have the automatic opening effect and the self-closing buffer effect for drawers, and also can reduce shocks and noises.

However, the aforementioned self-closing buffer and automatic opening functions cannot be integrated effectively, thus causing inconvenience to use. Even if these functions are integrated, users are unable to troubleshoot the problem on their own when there is a wrong operation that results in unsmooth operations or even damages of the slide rail mechanism. Obviously, the prior art requires further improvements.

SUMMARY OF THE INVENTION

It is a primary objective of the present invention to provide a self-closing buffer and automatic rebound mechanism for slide rails, such that when a drawer is pushed into a cabinet to a certain degree, the drawer is pulled back, closed, and locked at a position automatically, and the pushing force is buffered to reduce noises. After the drawer is pushed again, the drawer is bounced to a certain distance automatically to facilitate operations that follow, so as to improve the convenience of use significantly.

To achieve the aforementioned objectives, the present invention provides a self-closing buffer and automatic rebound mechanism for slide rail, such that when the drawer is pushed to a certain degree, the drawer is pulled back and locked at a locked position automatically, and the pushing force is buffered to reduce noises, and after the drawer is pushed again, the drawer is rebounded to a certain distance to facilitate operations that follow, so as to improve the convenience of use significantly.

To achieve the aforementioned objective, the present invention provides a self-closing buffer and automatic rebound mechanism for a slide rail, wherein the slide rail is comprised of an outer rail, a middle rail and an inner rail, such that the inner rail and the middle rail can be pulled sequentially outward and extended, or pushed inwardly, overlapped, and shortened, and the inner rail has a first trigger element, and the self-closing buffer and automatic rebound mechanism comprises:

a buffer body, disposed at an inner end of the outer rail, and having a containing groove and a pair of first engaging portions formed at the center of the buffer body, and the pair of first engaging portions being disposed parallelly on both sides of the containing groove, and an end of the buffer body being extended in a direction along the containing groove and having a long-strip block, and the long-strip block having a limit slide slot, and a first positioning portion and a second positioning portion being formed at both end portions of the limit slide slot respectively;

a buffer slide block, covered onto the exterior of the long-strip block, and capable of moving reciprocally in an extending direction of the long-strip block, and having a pivot hole formed on a lateral side of the buffer slide block and corresponding to the limit slide slot;

a buffer hook block, pivotally installed to the pivot hole, and having a limit block disposed on the bottom side of the buffer hook block and movably installed in the limit slide slot, such that when the buffer slide block is moved outwardly, the limit block can be latched to the first positioning portion, and when the buffer slide block is moved inwardly, the limit block can be latched to the second positioning portion, and the buffer hook block has a V-shaped grooved disposed on the top side of the buffer hook block to form two first openings, so that the first trigger element can be moved together with the inner rail, and movable into/out of the second opening, so that the first trigger element can be moved together with the inner rail and movable into/out of the first openings;

a buffer element, installed in the containing groove, and having an actuation rod disposed at an end of the buffer element, and an end of the actuation rod being coupled to the buffer slide block, for buffering the force produced when the buffer slide block is pulled back;

a pressing slide block, disposed with an interval apart from a side of the buffer slide block, and situated on a side of the buffer element, for abutting an end portion of the inner rail;

at least one pull-back spring, coupled between the buffer body and the buffer slide block, for pulling back the buffer slide block;

at least one push-out spring, coupled between the buffer slide block and the pressing slide block, for pushing out the buffer slide block;

a pressing toggle plate, being an L-shaped plate structure corresponding to the buffer hook block, and pivotally installed to the outer rail, and having a bump formed at an end on a side facing the inner rail, such that when the inner rail is driven to move outwardly or inwardly, the pressing toggle plate is linked to swing at different angles; and a pressing block, installed at an outer end of the inner rail, and having a first slide slot, a second slide slot and a third slide slot formed on the pressing block and corresponding to the bump of the pressing toggle plate, and the first slide slot, the second slide slot and the third slide slot being communicated with one another, and a divergent block being disposed between the first slide slot and the second slide slot, and a positioning block being disposed between the second slide slot and the third slide slot, and the divergent block has two second openings formed on a side of the pressing block and corresponding to the pressing toggle plate, such that when the pressing toggle plate is swung at different angles, the bump enters from one of the second openings to change a moving path to produce an rebounding or locking action.

In a preferred embodiment, a hook is bent from an end portion of the inner rail, and provided for driving the buffer hook block to resume its original position when the inner rail and the middle rail are pulled outwardly, so as to standardize the action. To further overcome wrong actions performed during an operation, users can troubleshooting the problems on their own, wherein the hook has a bevel portion corresponding to a side of the buffer hook block, such that when a wrong action is performed at the buffer hook block, the hook passes across the buffer hook block to resume its original position. In addition, the middle rail has a second trigger element corresponding to the pressing toggle plate, such that after the inner rail is pulled out completely, the pressing toggle plate can be pushed to resume its original position.

In a preferred embodiment, a third positioning portion is disposed on a side of the positioning block for temporarily latching the bump to define a locking status. In addition, a first moving path is formed at the first slide slot and along a side of the divergent block, and a second moving path is formed at the first slide slot and along the other side of the divergent block to the second slide slot, and a third moving path is formed at the second slide slot and along a side of the positioning block having the third positioning portion to the third slide slot, and a fourth moving path is formed at the third slide slot and along the other side of the positioning block. Therefore, there is a four-stage movement of the slide rail when the slide rail is pulled, and the first moving path is corresponsive to one of the second openings, and the second moving path and the fourth moving path are corresponsive to the other second opening. The four-stage movement design not just achieves the function of pressing the automatic opening only, but also resumes the pressing toggle plate to its original position during a wrong operation by pressing through this design.

DETAILED DESCRIPTION OF THE PREFERRED EMBODIMENTS

The technical content of the present invention will become apparent with the detailed description of preferred embodiments and the illustration of related drawings as follows.

Figure 1:
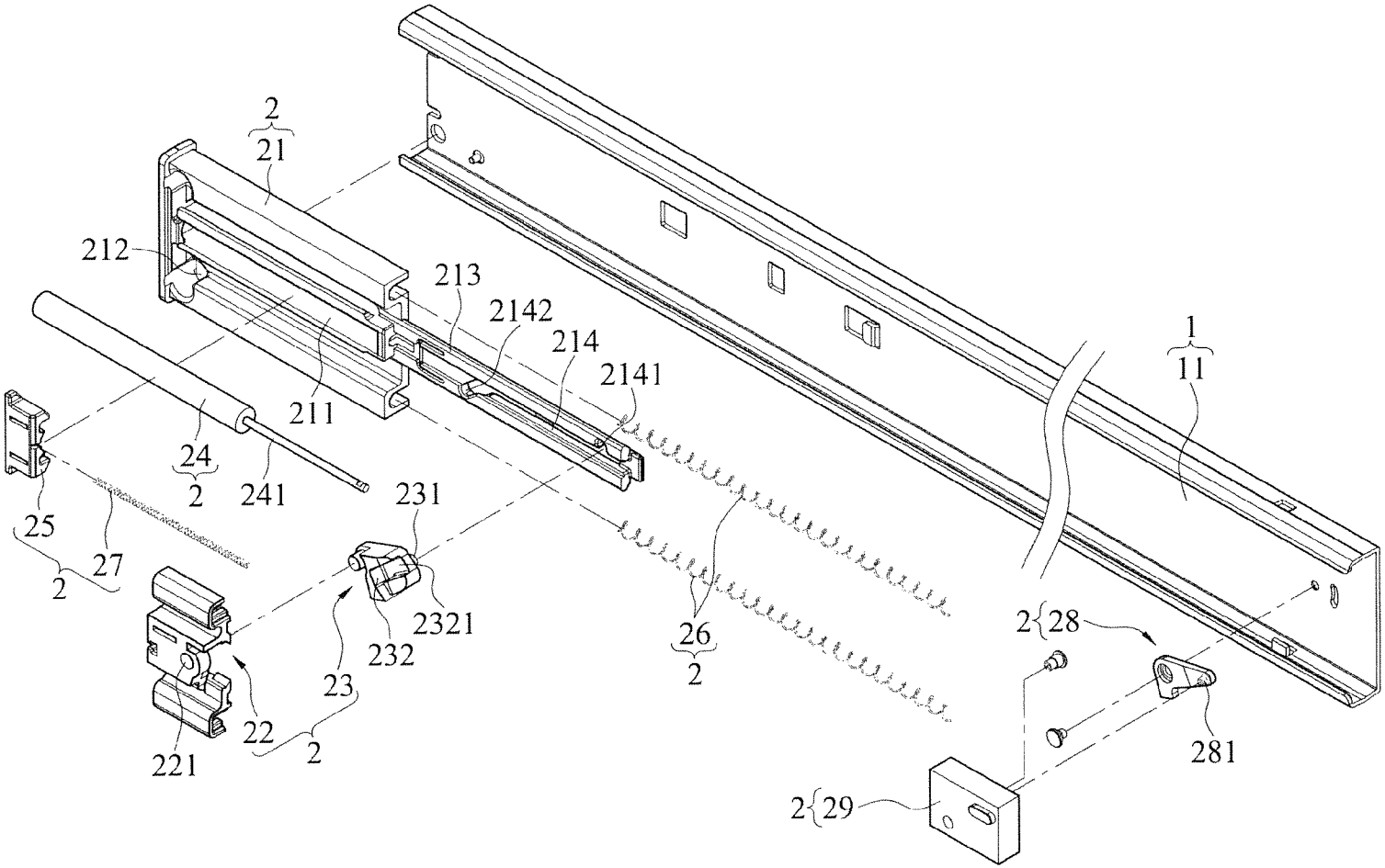
FIG. 1 is an exploded view of a preferred embodiment of the present invention viewing from a first angle.
Figure 2:
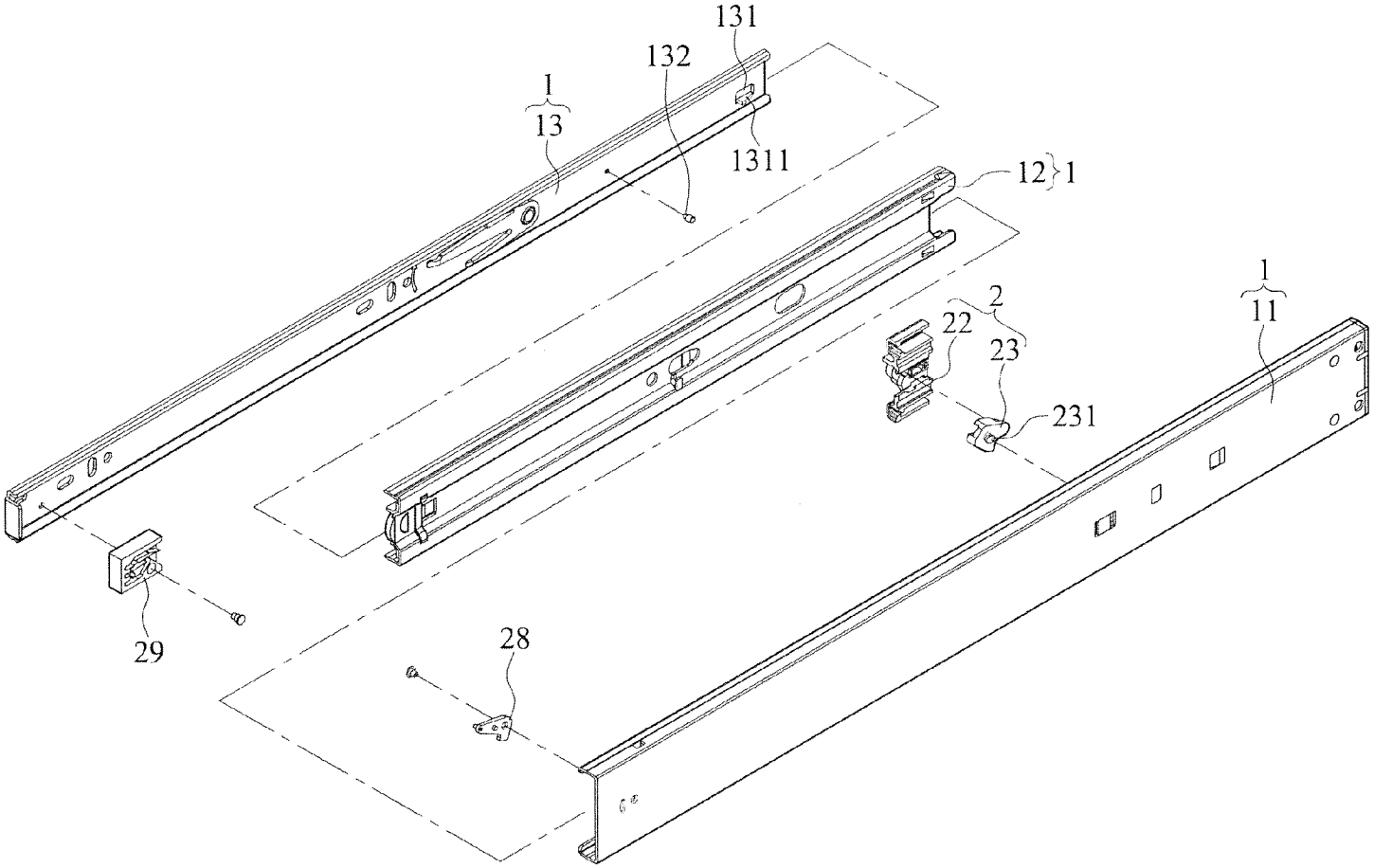
FIG. 2 is an exploded view of a preferred embodiment of the present invention viewing from a second angle.
Figure 3:
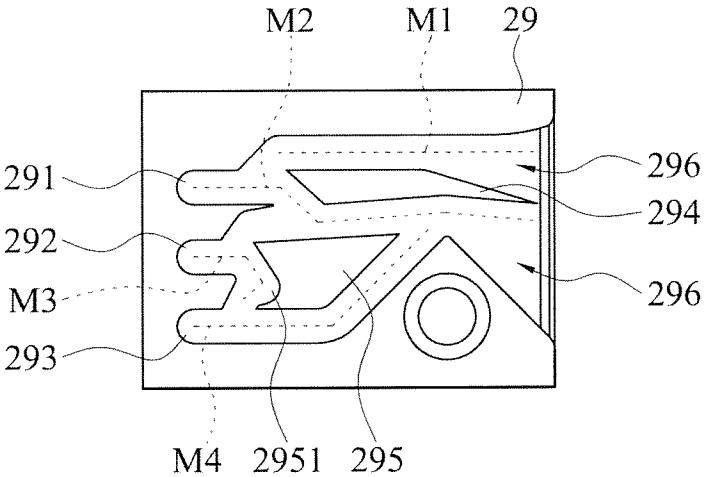
FIG. 3 is a schematic structural view of a pressing block of a preferred embodiment of the present invention.
Figure 4:
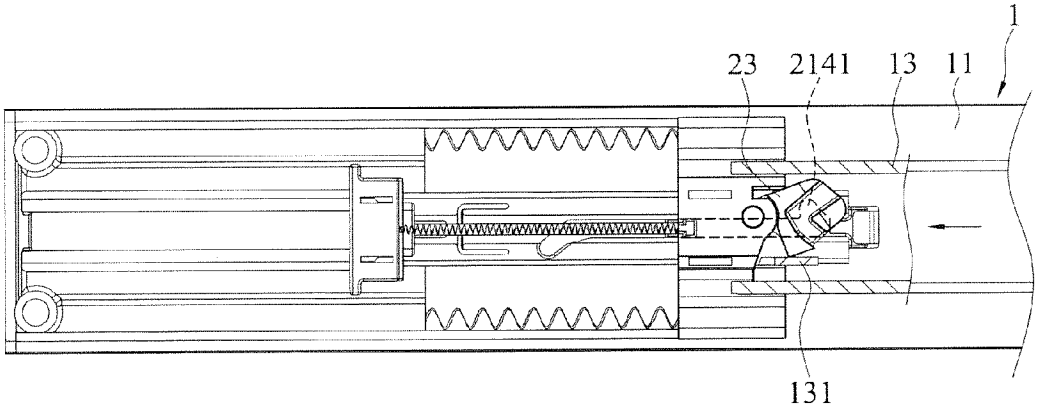
FIGS. 4 to 20 are schematic views of consecutive movements in accordance with a preferred embodiment of the present invention respectively.
Figure 5:
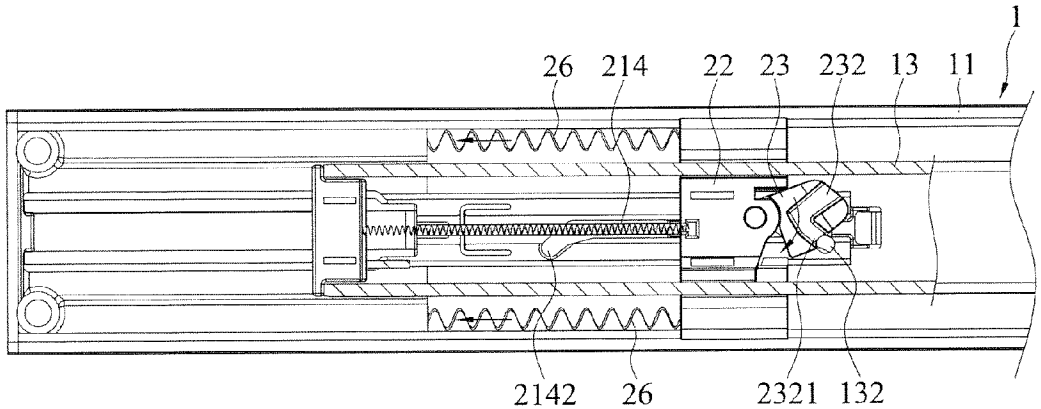
Figure 6:
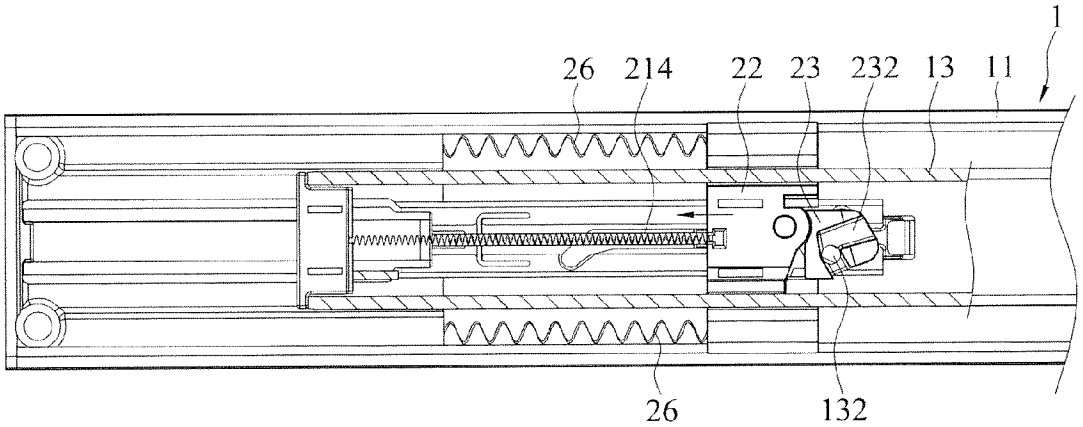
Figure 7:
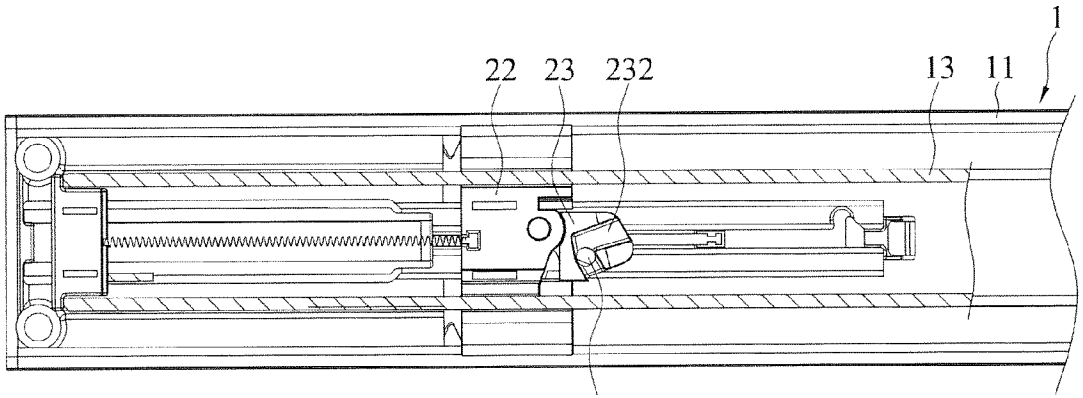
Figure 8:
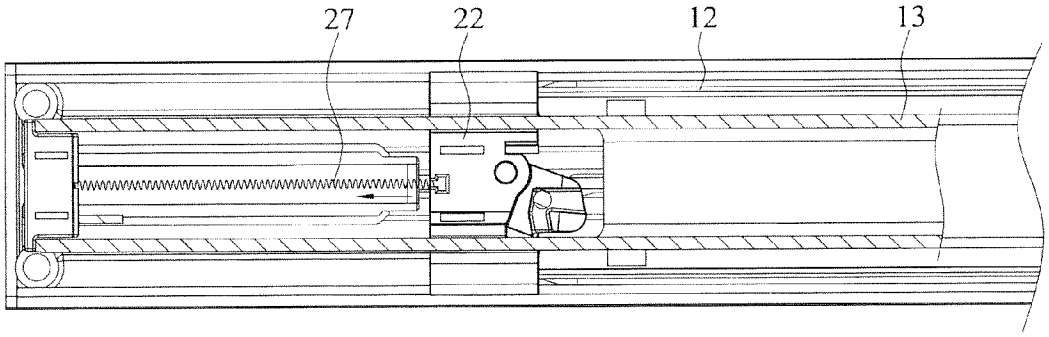
Figure 9:
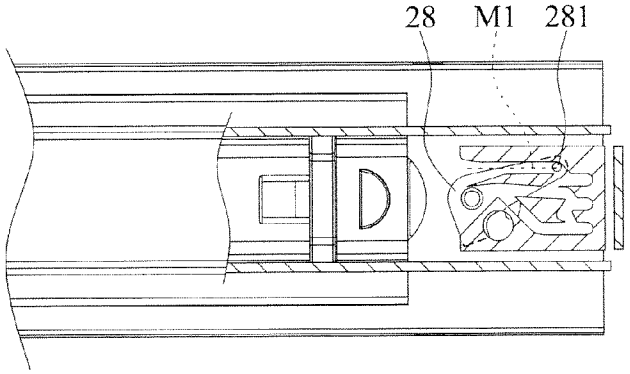
Figure 10:
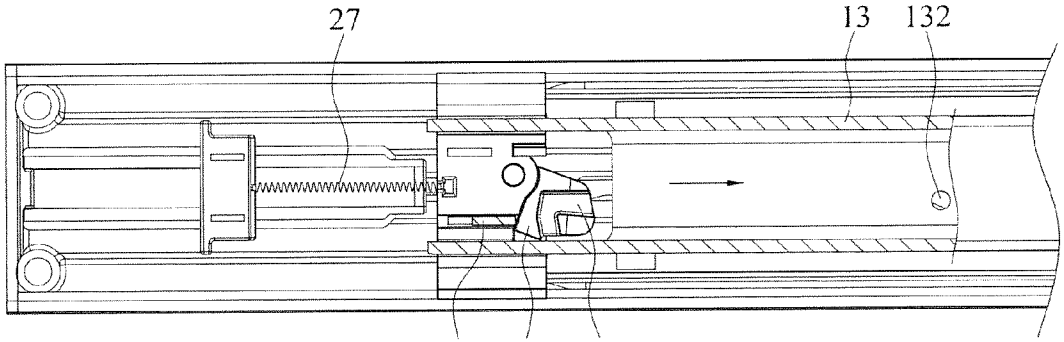
Figure 11:
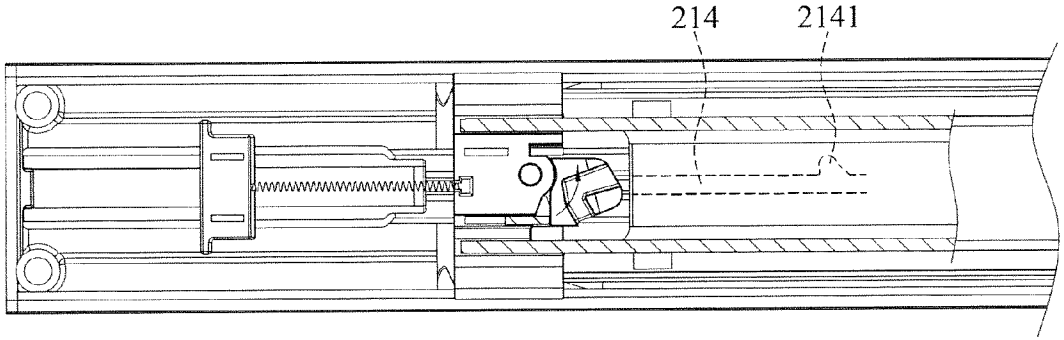
Figure 12:
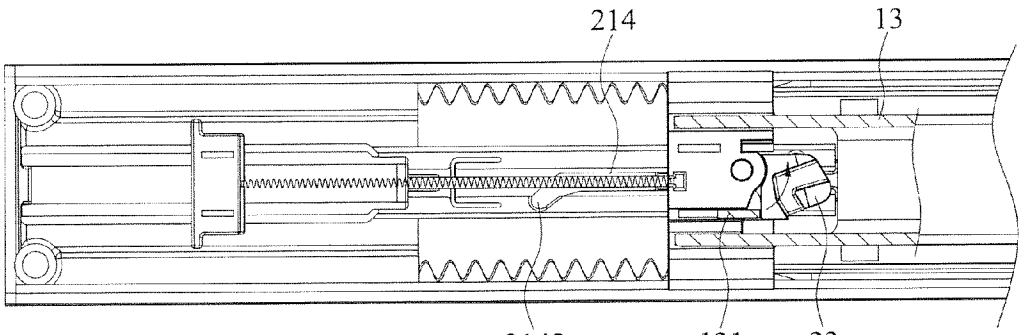
Figure 13:
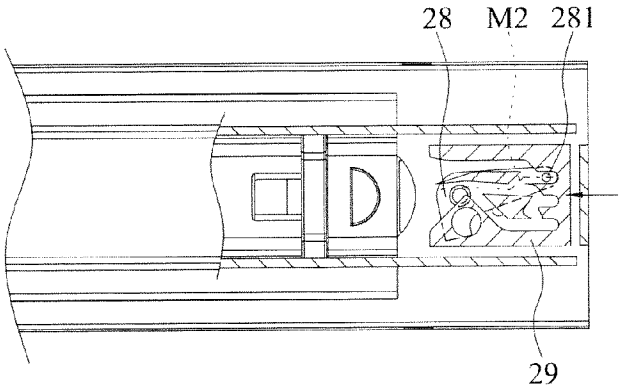
Figure 14:
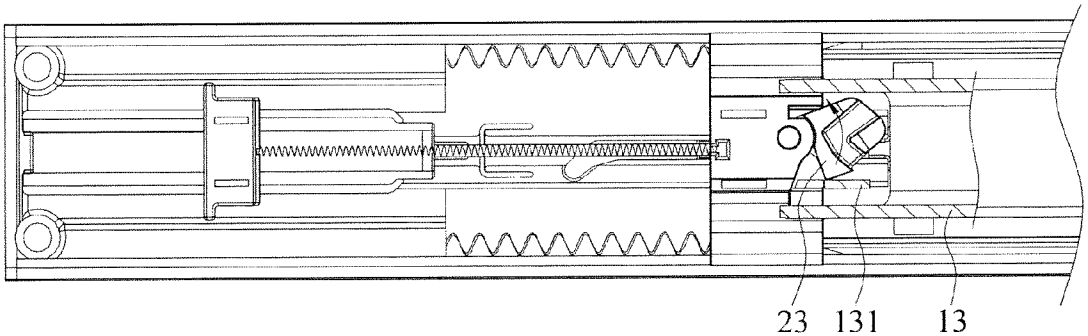
Figure 15:
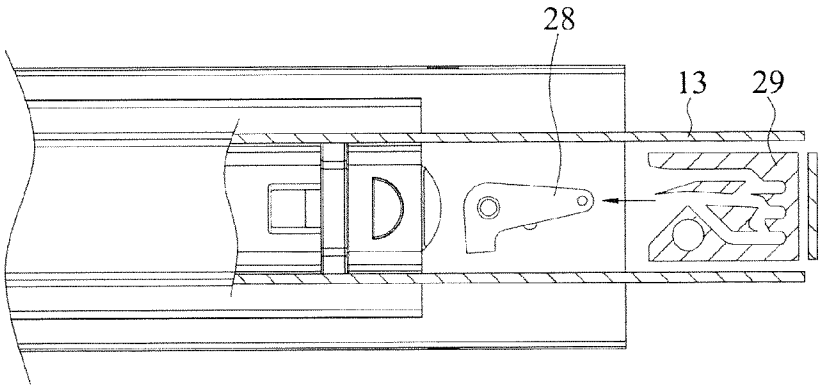
Figure 16:
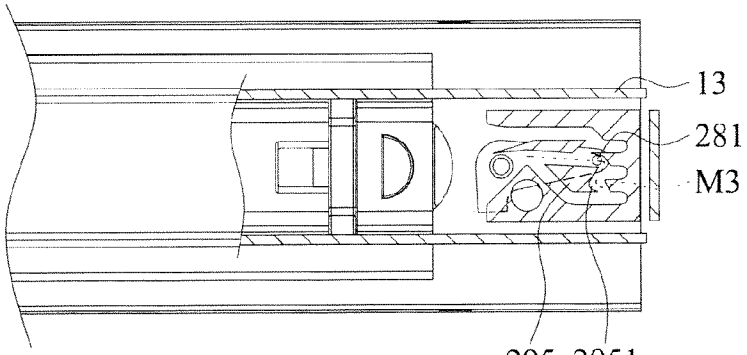
Figure 17:
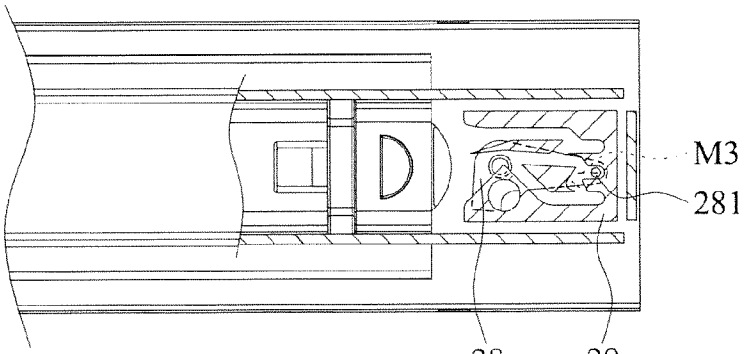
Figure 18:
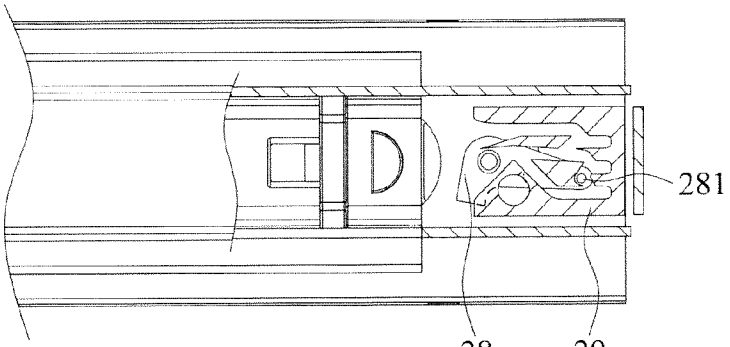
Figure 19:
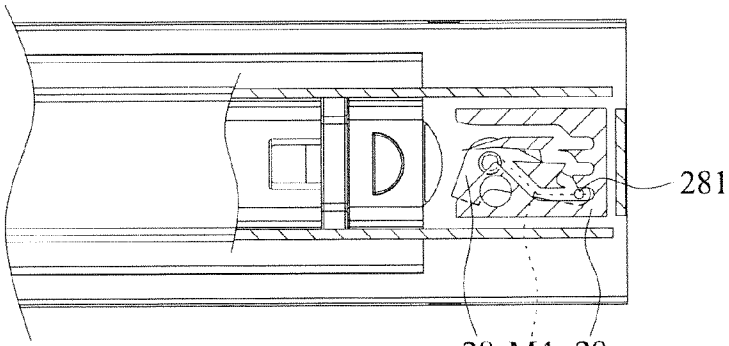
Figure 20:
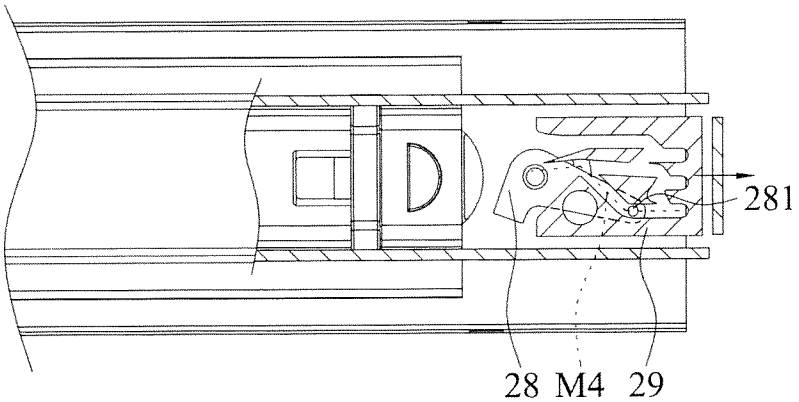

With reference to FIGS. 1 to 3 for the exploded views of a self-closing buffer and automatic rebound mechanism 2 of a slide rail 1 in accordance with a preferred embodiment of the present invention viewing from two different angles and a schematic structural view of a pressing block of a preferred embodiment of the present invention respectively, the slide rail 1 is comprised of an outer rail 11, a middle rail 12 and an inner rail 13, such that the inner rail 11 and the middle rail 12 can be pulled sequentially outward and extended for a longer length, or pushed inwardly and overlapped with each other for a shorter length, and the inner rail 13 includes a first trigger element 132. The self-closing buffer and automatic rebound mechanism 2 comprises a buffer body 21, a buffer slide block 22, a buffer hook block 23, a buffer element 24, a pressing slide block 25, a pair of pull-back springs 26, a push-out spring 27, a pressing toggle plate 28 and a pressing block 298.

The buffer body 21 is manufactured by plastic injection molding, and the buffer body 21 is corresponsive to the shape of the outer rail 11 and embedded into an inner side at an inner end of the outer rail 11, and a containing groove 211 and a pair of first engaging portions 212 are formed at the center of the buffer body 21, and the pair of first engaging portions 212 are disposed parallel to both sides of the containing groove 211 respectively, and an end of the buffer body 21 has a long-strip block 213 extended in an extending direction of the containing groove 211, and the long-strip block 213 has a limit slide slot 214, and a first positioning portion 2141 and a second positioning portion 2142 formed at both end portions of the limit slide slot 214 respectively, and the first positioning portion 2141 is an outer end position disposed at the long-strip block 213, and the second positioning portion 2142 is disposed at an intersection proximate to the buffer body 21.

The buffer slide block 22 is also manufactured by plastic injection molding, and the buffer slide block 22 is covered onto the exterior of the long-strip block 213 and moved reciprocally along the extending direction of the long-strip block 213, and a pivot hole 221 is formed at an edge of the buffer slide block 11 and corresponding to the limit slide slot 214.

The buffer hook block 23 is also manufactured by plastic injection molding, and an end of the buffer hook block 23 is pivotally installed to the pivot hole 221, and a limit block 231 is disposed at the bottom side of the buffer hook block 23 and movably installed into the limit slide slot 214. When the buffer slide block 22 synchronously drives the buffer hook block 23 to move outward, the limit block 231 can be latched to the first positioning portion 2141, and when the buffer slide block 22 synchronously drives the buffer hook block 23 to move inward, the limit block 231 can be latched to the second positioning portion 2142. In addition, a V-shaped groove 232 is formed at the top side of the buffer hook block 23 and has two first openings 2321, such that the first trigger element 132 can be moved together with the inner rail 13 and movable into/out of the first openings 2321 to link the buffer hook block 23 to move reciprocally.

The buffer element 24 can be a hydraulic rod or a pneumatic rod fixed into the containing groove 211, and an actuation rod 241 is disposed at an end of the buffer element 24, and an end of the actuation rod 241 is coupled to the buffer slide block 22, for buffering the force produced when the buffer slide block 22 is pulled back.

The pressing slide block 25 is also manufactured by plastic injection molding and disposed at a position with an interval from a side of the buffer slide block 22 and situated at a side of the buffer element 24 for abutting an inner end portion of the inner rail 13.

The pair of pull-back springs 26 is coupled between the first engaging portions 212 and the buffer slide block 22 of the buffer body 21, and the resilience force of the pair of pull-back springs 26 can pull back the buffer slide block 22 inwardly.

The push-out spring 27 is coupled between the buffer slide block 22 and the pressing slide block 25, and the resilience force of the push-out spring 27 can push the buffer slide block 22 outwardly.

The pressing toggle plate 28 is manufactured by plastic injection molding, and corresponding to the buffer hook block 23 and pivotally installed to the outer rail 11, and the pressing toggle plate 28 is an L-shaped plate structure having a bump 281 formed at an end and disposed on a side facing the inner rail for linking the pressing toggle plate 28 to swing a different angles when the inner rail 13 is driven to move outwardly or inwardly.

The pressing block 29 is manufactured by plastic injection molding and fixed to an outer end of the inner rail 13, and the pressing block 29 has a first slide slot 291, a second slide slot 292 and a third slide slot 293 corresponding to the bump 281 of the pressing toggle plate 28, and the first slide slot 291, the second slide slot 292 and the third slide slot 293 are communicated with one another, and a divergent block 294 is disposed between the first slide slot 291 and the second slide slot 292, and a positioning block 295 is disposed between the second slide slot 292 and the third slide slot 296, and the divergent block 294 has two second openings 296 formed on a side of the pressing block 29 and corresponding to the pressing toggle plate 28. When the pressing toggle plate 28 is swung to a different angle, the bump 281 enters from one of the second openings 296 to change the moving path to perform a rebounding or locking action. In addition, a third positioning portion 2951 is disposed on a side of the positioning block 295 for temporarily latching the bump 281, and a first moving path M1 is formed at the first slide slot 291 and along a side of the divergent block 294, and a second moving path M2 is formed at the first slide slot 291 and from the other side of the divergent block 294 to the second slide slot 292, and a third moving path M3 is formed at the second slide slot 292 and from a side of the positioning block 295 to the third slide slot 293, and a fourth moving path M4 is formed at the third slide slot 293 and along the other side of the positioning block 295. In addition, the first moving path M1 is corresponsive to one of the second openings 296, and the second moving path M2 and the fourth moving path M4 are corresponsive to the other second opening 296.

In addition, a hook 131 is bent from an end of the inner rail 13 and provided for driving the buffer hook block 23 to resume its original position when the inner rail 13 and the middle rail 12 are pulled inwardly, and a bevel portion 1311 is formed on a side of the hook 131 and corresponding to the buffer hook block 23 and provided for passing across the buffer hook block 23 to resume the original position. In addition, the middle rail has a second trigger element corresponding to the pressing toggle plate, such that after the inner rail is pulled out completely, the pressing toggle plate can be pushed to resume its original position.

With reference to FIGS. 4 to 20 for the schematic views of consecutive movements in accordance with a preferred embodiment of the present invention respectively as well as FIGS. 1 to 3, when the inner rail 13 is pushed into the outer rail 11, the buffer hook block 23 is latched at a position of the first positioning portion 2141, so that the hook 131 can be dodged away from the buffer hook block 23 and passed through from the bottom, and then after the first trigger element 132 is entered into the first opening 2321 from the bottom of the buffer hook block 23 and the first trigger element 132 is latched into the V-shaped groove 231, the buffer hook block 23 is turned in an opposite direction to separate from the first positioning portion 2141 and return into the limit slide slot 214. After being acted by the action force of the two pull-back springs 26, the buffer slide block 22 is pulled to slide towards the innermost side of the slide rail 1 until it reaches the position of the second positioning portion 2142 and is latched. Therefore, the inner rail 13 is situated at a locked status. When it is necessary to have an automatic pressing rebound, the inner rail 13 drives the middle rail 12 to be pushed inwardly, so that the buffer slide block 22 is squeezed and pushed inwardly. In the meantime, the bump 281 of the pressing toggle plate 28 is moved along the first moving path M1, and the buffer hook block 23 is turned in an opposite direction, such that the first trigger element 132 can be separated from the V-shaped groove 231, and the inner rail 13 is situated at a released status, and then the resilience force of the push-out spring 27 drives the pressing slide block 25 to eject from the inner rail 13. Now, the hook 131 of the inner rail 13 is blocked by the buffer hook block 23, so that the buffer hook block 23 is turned in a forward direction and separated from the second positioning portion 2142. Until the buffer hook block 23 is moved to a position of the first positioning portion 2141, the buffer hook block 23 is rotated in the forward direction again to define a latched status, and the hook 131 can be released from the blocking of the buffer hook block 23. In the meantime, the bump 281 of the pressing toggle plate 28 is moved along the second moving path M2, and thus the bump 281 can be separated from the pressing block 29. If the inner rail 13 has not been pulled out completely and closed again, then the bump 281 will move along the third moving path M3 to latch to the third positioning portion 2951. After being pressed again, the bump 281 will be separated from the third positioning portion 2951 and entered into the fourth moving path M4, so that the pressing toggle plate 28 can be separated from the pressing block 29 to return to the press rebounding status. In summation of the description above, the present invention emphasizes on the convenient operation and foolproof operation. Even if there is a wrong movement, the invention allows the users to troubleshoot the problem on their own conveniently.

What is claimed is:

1. A self-closing buffer and automatic rebound mechanism for slide rail, wherein the slide rail is comprised of an outer rail, a middle rail and an inner rail, such that the inner rail and the middle rail can be pulled sequentially outward and extended, or pushed inwardly, overlapped, and shortened, and the inner rail has a first trigger element, and the self-closing buffer and automatic rebound mechanism comprises:

a buffer body, disposed at an inner end of the outer rail, and having a containing groove and a pair of first engaging portions formed at the center of the buffer body, and the pair of first engaging portions being disposed parallel on both sides of the containing groove, and an end of the buffer body being extended in a direction along the containing groove and having a long-strip block, and the long-strip block having a limit slide slot, and a first positioning portion and a second positioning portion being formed at both end portions of the limit slide slot respectively;

a buffer slide block, covered onto the exterior of the long-strip block, and capable of moving reciprocally in an extending direction of the long-strip block, and having a pivot hole formed on a lateral side of the buffer slide block and corresponding to the limit slide slot;

a buffer hook block, pivotally installed to the pivot hole, and having a limit block disposed on the bottom side of the buffer hook block and movably installed in the limit slide slot, such that when the buffer slide block is moved outwardly, the limit block can be latched to the first positioning portion, and when the buffer slide block is moved inwardly, the limit block can be latched to the second positioning portion, and the buffer hook block has a V-shaped groove disposed on the top side of the buffer hook block to form two first openings, so that the first trigger element can be moved together with the inner rail, and movable into or out of the second openings, so that the first trigger element can be moved together with the inner rail and movable into or out of the first openings;

a buffer element, installed in the containing groove, and having an actuation rod disposed at an end of the buffer element, and an end of the actuation rod being coupled to the buffer slide block, for buffering the force produced when the buffer slide block is pulled back;

a pressing slide block, disposed with an interval apart from a side of the buffer slide block, and situated on a side of the buffer element, for abutting an end portion of the inner rail;

at least one pull-back spring, coupled between the buffer body and the buffer slide block, for pulling back the buffer slide block;

at least one push-out spring, coupled between the buffer slide block and the pressing slide block, for pushing out the buffer slide block;

a pressing toggle plate, being an L-shaped plate structure corresponding to the buffer hook block, and pivotally installed to the outer rail, and having a bump formed at an end on a side facing the inner rail, such that when the inner rail is driven to move outwardly or inwardly, the pressing toggle plate is linked to swing at different angles; and a pressing block, installed at an outer end of the inner rail, and having a first slide slot, a second slide slot and a third slide slot formed on the pressing block and corresponding to the bump of the pressing toggle plate, and the first slide slot, the second slide slot and the third slide slot being communicated with one another, and a divergent block being disposed between the first slide slot and the second slide slot, and a positioning block being disposed between the second slide slot and the third slide slot, and the divergent block has two second openings formed on a side of the pressing block and corresponding to the pressing toggle plate, such that when the pressing toggle plate is swung at different angles, the bump enters from one of the second openings to change a moving path to produce a rebounding or locking action.

2. The self-closing buffer and automatic rebound mechanism for slide rail according to claim 1, further comprising a hook bent from an end portion of the inner rail, and provided for driving the buffer hook block to resume its original position when the inner rail and the middle rail are pulled outwardly.

3. The self-closing buffer and automatic rebound mechanism for slide rail according to claim 2, wherein the hook includes a bevel portion corresponding to a side of the buffer hook block and passed across the buffer hook block to resume its original position.

4. The self-closing buffer and automatic rebound mechanism for slide rail according to claim 1, wherein the positioning block has a third positioning portion disposed on a side of the positioning block for temporarily latching the bump.

5. The self-closing buffer and automatic rebound mechanism for slide rail according to claim 4, wherein a first moving path is formed at the first slide slot and along a side of the divergent block, and a second moving path is formed at the first slide slot and along the other side of the divergent block to the second slide slot, and a third moving path is formed at the second slide slot and along a side of the positioning block having the third positioning portion to the third slide slot, and a fourth moving path is formed at the third slide slot and along the other side of the positioning block.

6. The self-closing buffer and automatic rebound mechanism for slide rail according to claim 5, wherein the first moving path is corresponsive to one of the second openings, and the second moving path and the fourth moving path are corresponsive to the other second opening.

7. The self-closing buffer and automatic rebound mechanism for slide rail according to claim 1, wherein the middle rail has a second trigger element corresponsive to the pressing toggle plate for pushing the pressing toggle plate to resume its original position after the inner rail is pulled out completely.

* * * * *